US005993022A

United States Patent [19]

Neyer et al.

[11] Patent Number: 5,993,022

[45] Date of Patent: Nov. 30, 1999

[54] MULTI-PIVOT FLASHLIGHT

[75] Inventors: James U. Neyer, Middleton, Wis.; Kai C. A. Yau, Kowloon, The Hong Kong Special Administrative Region of the People's Republic of China

[73] Assignee: Rayovac Corporation, Madison, Wis.

[21] Appl. No.: 09/112,167

[22] Filed: Jul. 8, 1998

[51] Int. Cl.[6] ..... F21L 7/00

[52] U.S. Cl. ..... 362/199; 362/287

[58] Field of Search ..... 362/197, 199, 362/269, 285, 287

[56] References Cited

U.S. PATENT DOCUMENTS

| | | | |
|---|---|---|---|
| D. 332,320 | 1/1993 | Gammache . | |
| D. 375,570 | 11/1996 | Hayakawa et al. . | |
| D. 375,811 | 11/1996 | Hon . | |
| D. 390,986 | 2/1998 | Yuen . | |
| 1,284,502 | 11/1918 | Walton . | |
| 3,851,166 | 11/1974 | Kohler . | |
| 4,129,899 | 12/1978 | Dunbar | 362/199 X |
| 4,459,646 | 7/1984 | Drane . | |
| 4,533,982 | 8/1985 | Kozar . | |
| 4,777,572 | 10/1988 | Ambasz . | |
| 5,541,822 | 7/1996 | Bamber . | |
| 5,738,432 | 4/1998 | Okko et al. . | |

OTHER PUBLICATIONS

"Specialty Lights Rayovac® Swivel–Lite™ Hands–Free Worklight" —Rayovac Corporation, Jan. 1998.

"Swivel–Lite™ " —Rayovac Coporation, no publication date.

"Swivel–Lite™ Flashlights Ad Slicks" —Rayovac Corporation, Jan. 1998.

"Display and Merchandising Program —Lights" —Rayovac Corporation, no publication date.

Exhibit A: Coleman Powermate Flashlight, no publication date.

Exhibit C: Sanyo LAO LK–3204 Flashlight, no publication date.

Exhibit B: Garrity Flashlight, no publication date.

*Primary Examiner*—Stephen Husar

*Attorney, Agent, or Firm*—Lathrop & Clark LLP

[57] ABSTRACT

A flashlight has a center pivot mechanical connection between a plastic battery housing and a rotatable plastic turret, permitting free rotation of the turret. A lamp housing is pivotable within the turret about an axis perpendicular to the center pivot. Electrical connection between the lamp within the lamp housing, and the batteries within the battery housing is provided by two pairs of ring and point contacts mounted to the turret and the battery housing, and by ring contacts connected to the lamp housing surrounding the pivot axis of the lamp housing which engage with a point contact and ring contact in the turret. The light may thus be pointed in any direction in the hemisphere above the battery housing. A snap ring securely retains the turret to the battery housing while permitting free rotation about the rigid center pivot which does not provide electrical connection.

15 Claims, 2 Drawing Sheets

MULTI-PIVOT FLASHLIGHT

FIELD OF THE INVENTION

The present invention relates to portable light devices in general, and in particular to flashlights which have a light head which is adjustable in Position with respect to the flashlight body.

BACKGROUND OF THE INVENTION

The portable flashlight has been used for many years to provide targeted illumination under a wide variety of circumstances. From the heavy duty lantern type flashlight which provides wide area lighting, to the pocket "pen" light, these devices share several common features: a light-emitting bulb, one or more batteries, a series of leads and contacts extending between the batteries and the bulb, and a switch for activating the light.

Advances in battery chemistry and light bulb and reflector design have made possible flashlights of greater illumination power in smaller packages. In some applications it is desirable to position the flashlight in a fixed location to direct a beam of light onto an area of interest, while leaving the user's hands free. Flashlights with bulb housings or heads which are pivotable allow a flashlight which is resting on a support or fixed to a user's garments to direct light onto a desired area. One approach has been to mount the entire flashlight, including the batteries, on a pivotable fixture. A more common approach is to have a mechanical joint which permits positioning of the head, and through which flexible wire leads extend to connect the bulb to the batteries. A wire lead presents several problems in a swivel head flashlight. First, if the head is capable of uninterrupted 360 degree rotation, continuous rotation may cause the wire lead to be twisted and eventually severed. In any event, frequent flexure of the wire leads can lead to fatigue and eventual failure of the leads, with the flashlight thus rendered inoperative. Other flashlights have moving contacts between the head and the body, but such lights permit rotation only about a single axis of rotation.

Flashlights with a center conductive pivot, which acts as both an electrical and mechanical connection between the light housing and the batteries are known. The narrow diameter of such pivots, however, tends to compromise the rigidity of the mechanical connection, making the flashlight prone to failure, especially if dropped or impacted.

What is needed is a durable flashlight with a head which is pivotable about multiple axes.

SUMMARY OF THE INVENTION

The flashlight of this invention has a center pivot mechanical connection between a plastic battery housing and a rotatable plastic turret. While the turret is free to rotate about the center pivot, a lamp housing is pivotable within the turret about an axis perpendicular to the center pivot. Electrical connection between the lamp within the lamp housing, and the batteries within the battery housing is provided by two pairs of ring and point contacts mounted to the turret and the battery housing, and by ring contacts connected to the lamp housing surrounding the pivot axis of the lamp housing which engage with a point contact and ring contact in the turret. This arrangement permits the light to be pointed in any direction in the hemisphere above the battery housing, while a snap ring securely retains the turret to the battery housing while permitting free rotation about the rigid center pivot which does not provide electrical connection.

It is an object of the present invention to provide a flashlight with a lamp which is pivotable about multiple axes.

It is another object of the present invention to provide a flashlight with a pivotable lamp in which the mechanical and electrical linkages are distinct.

It is a further object of the present invention to provide a lighting device with a positionable lamp which is rugged.

It is an additional object of the present invention to provide a compact pivoting head flashlight.

Further objects, features and advantages of the invention will be apparent from the following detailed description when taken in conjunction with the accompanying drawings.

DESCRIPTION OF THE PREFERRED EMBODIMENT

Figure 1:
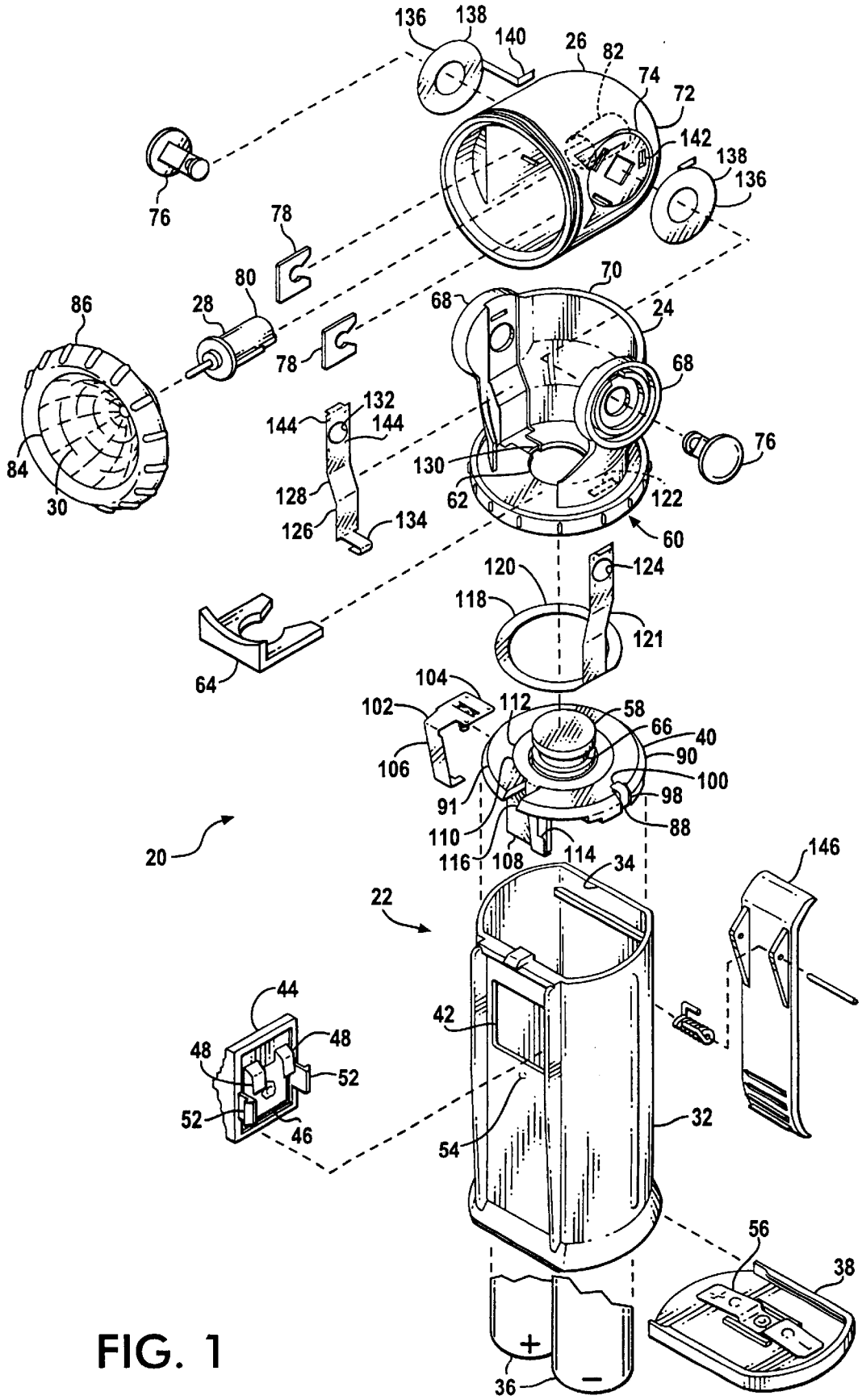
FIG. 1 is an exploded isometric view of the swivel-head flashlight of this invention.
Figure 2:
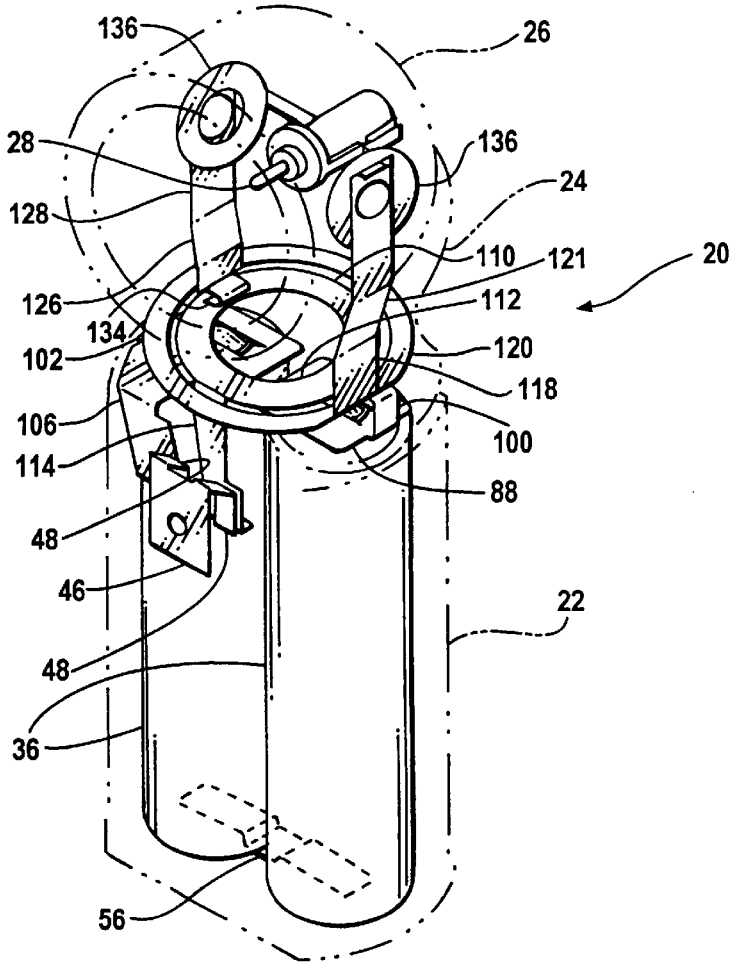
FIG. 2 is an isometric view of the electrical system of the flashlight of FIG. 1, with the flashlight body shown in phantom view.
Figure 3:
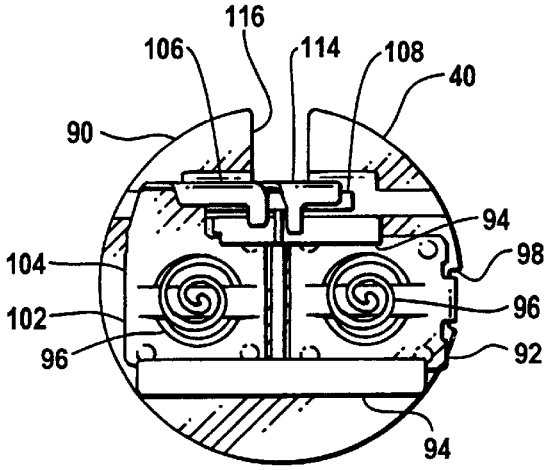
FIG. 3 is a bottom plan view of the underside of the head of the flashlight of FIG. 1.

Referring more particularly to FIGS. 1–3, where like numbers refer to similar parts, a swivel-head flashlight 20 is shown. The flashlight 20 has a body 22 to which a rotatable turret 24 is mounted. A lamp housing 26 pivots within the turret 24, to permit a lamp 28 within a reflector 30 to be positioned at a desired orientation with respect to the body.

The body 22 has a molded plastic main portion 32 which defines a compartment 34 which receives two AA batteries 36. The main portion 32 is selectably closed by a battery door 38 which is slidably received in slots at the base of the main portion. The top of the main portion 32 of the body 22 is closed by a molded plastic head 40 which is fused or sealed to the body main portion 32.

The body main portion has a side opening 42 which receives a switch element 44 for vertical travel within the opening. The switch element 44 has an electrically conductive switch member 46 which is attached or fused to the plastic of the switch element. The conductive switch member has two resilient contacts 48 which extend into the battery compartment 34. The switch element 44 has side rails 52 which snap into engagement with the body side opening 42 and which restrain the switch for vertical motion. A stud 54 beneath the side opening 42 engages with a recess in the switch element to retain the switch element in an open or a closed condition.

A bottom contact 56 is fused to the battery door 38. The bottom contact 56 has resilient positive and negative prongs which extend between the lower ends of the two AA batteries 36 and form an electrical circuit between the two batteries.

The plastic head 40 has an upwardly protruding nonelectrically conductive pivot axle 58 which extends along a vertical axis and which defines the mechanical bearing about which the turret rotates. The turret 24 is molded plastic, and has a generally planar base 60 with an axle opening 62 centered therein. The turret 24 is positioned over the pivot axle 58 on the body 22, so the pivot axle protrudes into the turret. The turret 24 is connected to the body and allowed to rotate about the pivot axle by a plastic snap ring connector 64 which engages within a circumferential groove 66 in the pivot axle 58. The turret 24 has two ears 68 which extend upwardly from the turret base 60. The ears 68 are joined by a generally cylindrical collar 70. The lamp housing 26 has a generally spherical rear portion 72 which rotates against the collar 70. The lamp housing 26 has two spaced planar side walls 74 which engage against the turret ears 68, and through which plastic fasteners 76 extend to pivotably mount the lamp housing 26 to the turret 24. A snap ring 78 is positioned within the lamp housing 26 on each plastic fastener 76. The lamp 28, which is preferably secured within a modular plug 80 is received in a friction fit within a plastic receptacle 82 extending from the lamp housing 26. A transparent lens 84 is preferably fused to the plastic reflector 30, and gripped within a bezel 86 which is threadably engaged to the lamp housing 26. The reflector 30 is preferably of the faceted type, and, because a metallic film has been deposited on the front surface of the reflector, is kept from marring contact with a user's fingers by the affixed lens 84. The reflector opens rearwardly to admit the small lamp 28 when the bezel 86 is screwed to the lamp housing 26.

The lamp housing 26 pivots about a generally horizontal axis defined by the two plastic fasteners 78 with a range of rotation of about 90 degrees. The turret, on the other hand, rotates uninterrupted in either direction about the pivot axle 58, thereby allowing the lamp to be directed in any direction toward the hemisphere above the body 22.

The flashlight 20 eliminates flexible wires in fatigue-prone positions by using a series of bent metal plate contacts to continuously maintain a circuit between the lamp plug 80 and the batteries 36 within the body 22.

As shown in FIG. 2, a first battery contact element 88 is connected to the body head 40. The body head 40 has a disc 90 which defines the upper planar surface 91 on which the turret 24 rotates. The first battery contact element 88 has a lower segment 92 which is engaged in a snap fit with rails 94 on the underside of the disc 90, as shown in FIG. 3. A conductive spring 96 extends downwardly from the first battery contact element 88 to make electrical contact with one of the batteries 36. The first battery contact element 88 has portions which extend upwardly through a slot 98 at the periphery of the head disc 90 and folds over onto the upper surface of the disc 90. The portion of the first battery contact element which extends radially inwardly along the disc upper surface defines a first point contact 100 which is in electrical communication with a battery 36.

A second battery contact element 102 has a lower segment 104 which is engaged in a snap fit with the rails 94 on the underside of the disc 90 and which is spaced from the first battery contact element 88. A conductive spring 96 extends downwardly from the second battery contact element 102 to make electrical contact with the second of the batteries 36. The second battery contact element 102 has a leg 106 which is bent at approximately 90 degrees to extend downwardly and frontwardly along a front wall 108 which extends downwardly from the head disc 90, to make contact with the switch contacts 48 of the switch member 46 when the switch is in the on position.

A first ring contact 110 has an annular ring 112 which extends along the upper surface 91 of the disc 90 and which is positioned around the pivot axle 58. The first ring contact 110 has a leg 114 which extends downwardly from the ring 112 through a front slot 116 in the disc 90 and along the head front wall 108. The leg 114 thus extends in the same plane as the second battery contact element leg 106 and is positioned to make contact with the other of the switch contacts 48 when the switch member is in the on position. The annular ring 112 is spaced radially inwardly from the first point contact 100.

A second ring contact 118 is connected to the turret 24 in a snap fit. The second ring contact 118 has a generally annular ring 120 which is engaged against the base 60 of the turret 24 and which overlies the first point contact 100. The second ring contact ring 120 is larger in diameter than the ring 112 of the first ring contact 110 and does not engage the first ring contact. The two rings 110, 120, are however, coaxial with one another. The second ring contact 118 has a leg 121 which extends upwardly from the ring 120 through a slot 122 in the turret 24 and along the interior of one of the turret ears 68. The leg 121 has an opening 124 through which the plastic fastener 76 extends.

A second point contact element 126 is also snap fit to the turret 24. The second point contact element 126 has a leg 128, similar to the second ring contact leg 121, which extends through a slot 130 in the base of the turret which opens off the turret axle opening 62. The leg 128 has an opening 132 through which the other plastic fastener 76 extends. The second point contact element 126 has a point contact 134 which extends along the base 60 of the turret 24 to overlie in sliding engagement the ring 112 of the first ring contact 110. As the turret 24 is rotated about the pivot axle 58, the second ring contact 118 and the second point contact element 126 are maintained in continuous electrical contact with the first point contact and the first ring contact respectively on the body head.

As shown in FIG. 1, a lamp ring contact 136 is engaged in a snap fit on either side of the lamp housing 26. Each lamp ring contact 136 has an annular ring 138 which extends along the planar walls 74 of the lamp housing 26. A leg 140 extends from each ring 138 through a slot 142 in the lamp housing 26 and is bent to extend parallel to the ring within the lamp housing. The bent legs 140 of the lamp ring contacts 136 are positioned to extend parallel to one another within the lamp housing to make electrical contact with the leads of the lamp plug 80. As the lamp housing 26 is pivoted within the turret 24, the lamp ring contacts 136 make sliding contact with the legs 121, 128 of the second ring contact 118 and the second point contact element 126. To assist in maintaining a consistent electrical engagement between the lamp ring contacts and the legs 121, 128, the legs are preferably provided with a plurality of small protrusions 144.

Each lamp ring contact and the engaging contact leg extending along the turret comprises a slip ring assembly. A slip ring assembly is defined as an electrical connection which allows current to pass through a rotating joint and incorporates a continuous ring on one side of a joint and a pickup which rides on the ring and is mounted to the opposite side of the joint, a slip ring assembly accommodates a structural bearing which passes through the ring.

As shown in FIG. 2, when the switch is in the on position, an uninterrupted electrical circuit is completed between the batteries 36 and the lamp 28 throughout the positioning travel of the lamp housing with respect to the body 22. The bottom contact 56 makes a circuit between the base of the two batteries, and the rotating contact elements maintain the circuit with the fixed contact elements on the body as the turret is rotated about the head pivot axle and as the lamp housing is rotated about the plastic fasteners 76.

The capability of the lamp housing to be selectably pivoted about more than one axis allows the light of the flashlight to be directed toward a particular area while the flashlight body remains fixed. The flashlight body 22 may be provided with a resilient or spring-loaded clip 146 as shown in FIG. 1.

It should be noted that the contacts, although preferably made of brass, may be formed of any appropriately conductive and springy material, for example copper alloyed with a material to give it proper spring properties, which as known to those skilled in the art would generally include zinc, tin or beryllium.

It should be noted that, although a AA battery flashlight has been illustrated, the flashlight of this invention may be made in larger or smaller sizes to work with different batteries and to serve needs for more powerful light sources, for example in a lantern type flashlight.

It is understood that the invention is not limited to the particular construction and arrangement of parts herein illustrated and described, but embraces such modified forms thereof as come within the scope of the following claims.

We claim:

1. A flashlight comprising:

a body having portions defining a battery compartment which receives at least one battery;

portions which protrude upwardly from the body to define a pivot axle which is not in an electrical circuit with the battery, the pivot axle defining a vertical pivot axis;

a rotatable turret mounted to the body to rotate about the pivot axle;

a lamp housing mounted to the turret and rotatable about a second pivot axis which is not parallel to the vertical pivot axis;

a first ring contact which is fixed to the housing and which encircles the pivot axle, the first ring contact having portions which extend into the body to make electrical contact with a first end of a battery;

a first point contact extending in approximately the plane of the first ring contact and spaced radially outwardly from the first ring contact, the first point contact extending into electrical contact with a second end of said battery;

a second ring contact mounted to the turret and extending in sliding engagement with the first point contact, such that electrical contact between the first point contact and the second ring contact is maintained as the turret is rotated about the pivot axle;

a second point contact mounted to the turret and extending in sliding engagement with the first ring contact, such that electrical contact between the first ring contact and the second point contact is maintained as the turret is rotated about the pivot axle; and leads extend from the second ring contact and the second point contact to a lamp mounted in the lamp housing, such that current from said battery may cause the illumination of the lamp at any orientation of the lamp housing within the turret.

2. The flashlight of claim 1 wherein the first ring contact has a ring portion which is positioned within a ring portion of the second ring contact.

3. The flashlight of claim 1 wherein the leads which extend from the second ring contact and the second point contact to the lamp in the lamp housing comprise:

a first lamp ring contact mounted to the lamp housing, the first lamp ring contact having a ring portion positioned on the exterior of the lamp housing, and a leg which extends from the ring portion into the interior of the lamp housing, the first ring contact ring portion making electrical contact with portions of the second ring contact; and a second lamp ring contact mounted to the lamp housing, the second lamp ring contact having a ring portion positioned on the exterior of the lamp housing, and a leg which extends from the ring portion into the interior of the lamp housing, the second ring contact ring portion making electrical contact with portions of the second point contact.

4. The flashlight of claim 4 wherein the first lamp ring contact and the second lamp ring contact each have portions defining a lamp ring contact hole, and further comprising two fasteners which pivotably mount the lamp housing to the turret, wherein each fastener extends through the turret, through the adjacent lamp ring contact hole, and through a hole in the lamp housing.

5. The flashlight of claim 1 wherein the turret has portions defining a downwardly opening circular hole, and wherein the pivot axle extends upwardly through said hole, and a snap ring engages with a groove in the pivot axle to retain the turret on the body.

6. A flashlight comprising:

a plastic electrically nonconductive body, having portions defining a compartment which receives at least one battery therein;

a circular nonelectrically conductive head which is fixed to the body, the head having portions which extend upwardly to define a pivot axle of a first diameter;

a plastic turret having a generally circular base with portions defining a circular hole of a diameter greater than the first diameter, the turret being rotatably mounted to the head such that the pivot axle extends upwardly through said circular hole, the turret having two upwardly extending ears;

a plastic lamp housing with two side walls which extend adjacent the turret ears, the lamp housing being received within the turret for rotation about an axis approximately perpendicular to the pivot axle;

a lamp engaged within the lamp housing;

a first ring contact element fixed to the body, the first ring contact element having an annular ring portion with an inner diameter greater than the first diameter and an outer diameter of a second diameter, the ring portion encircling the pivot axle on the head, and portions of the first ring contact element extend downwardly from the head into the compartment;

a second ring contact element fixed to the base of the turret and rotatable with the turret, the second ring contact element having an annular ring portion with an inner diameter greater than the second diameter and which overlies the head and extends in approximately the plane of the first ring contact element ring portion but which does not make contact with the first ring contact element ring portion, the second ring contact element having portions defining a leg which extends upwardly along one of the turret ears;

a first point contact which has portions which extend along the head in approximately the same plane as the ring portion of the first ring contact element, portions of the first point contact extending into the compartment to engage a battery, the first point contact making an electrical connection with the overlying ring portion of the second ring contact element; and a second point contact fixed to the turret and rotatable with the turret, the second point contact having portions which extend in approximately the same plane as the ring portion of the second ring contact element, the second point contact having portions which extend upwardly along one ear of the turret, the second ring contact element leg and the second point contact element leg making electrical contact with leads on the lamp housing which make an electrical connection with the lamp within the lamp housing, such that electrical contact between the at least one battery in the body compartment and the lamp in the lamp housing is maintained as the turret and the lamp housing are rotated.

7. The flashlight of claim 6 wherein the leads which extend from the second ring contact and the second point contact to the lamp in the lamp housing comprise:

a first lamp ring contact mounted to the lamp housing, the first lamp ring contact having a ring portion positioned on one of the two sides of lamp housing, and a leg which extends from the ring portion into the interior of the lamp housing, the first ring contact ring portion making electrical contact with portions of the second ring contact; and a second lamp ring contact mounted to the lamp housing, the second lamp ring contact having a ring portion positioned on the other of the two sides of the lamp housing, and a leg which extends from the ring portion into the interior of the lamp housing, the second ring contact ring portion making electrical contact with portions of the second point contact.

8. The flashlight of claim 7 wherein the first lamp ring contact and the second lamp ring contact each have portions defining a lamp ring contact hole, and further comprising two fasteners which pivotably mount the lamp housing to the turret, wherein each fastener extends through the turret, through the adjacent lamp ring contact hole, and through a hole in the lamp housing.

9. The flashlight of claim 6 wherein a snap ring engages with a groove defined by portions of the pivot axle to retain the turret on the body.

10. A flashlight comprising:

a battery housing;

a turret mounted to rotate on the battery housing about a first axis;

a first conductor extending from the battery housing, the first conductor positioned spaced from the first axis and positioned beneath the turret;

a second conductor extending from the battery housing, the second conductor positioned spaced from the first axis and radially inward of the first conductor and positioned beneath the turret;

a light bulb mounted in a lamp housing, the lamp housing mounted to the turret by a first pivot and a second pivot to rotate about a second axis substantially perpendicular to the first axis;

means forming a first conductive path between the light bulb through the first pivot and connecting to the first conductor, the means including a slip ring assembly positioned about the first axis; and means forming a second conductive path between the light bulb through the second pivot and connecting to the second conductor, the means including a slip ring assembly positioned about the first axis.

11. The flashlight of claim 10 wherein the means forming a first conductive path includes a slip ring assembly at the first pivot.

12. The flashlight of claim 10 wherein means forming a first conductive path includes a first ring contact ring portion which is positioned within a ring portion of the means forming a second conductive path.

13. The flashlight of claim 10 wherein the means forming a first conductive path and the means forming a second conductive path further comprise:

a first lamp ring contact mounted to the lamp housing, the first lamp ring contact having a ring portion positioned on the exterior of the lamp housing, and a leg which extends from the ring portion into the interior of the lamp housing; and a second lamp ring contact mounted to the lamp housing, the second lamp ring contact having a ring portion positioned on the exterior of the lamp housing, and a leg which extends from the ring portion into the interior of the lamp housing.

14. The flashlight of claim 13 wherein the first lamp ring contact and the second lamp ring contact each have portions defining a lamp ring contact hole, and wherein the each of the first pivot and the second pivot extends through the turret, through the adjacent lamp ring contact hole, and through a hole in the lamp housing.

15. The flashlight of claim 10 wherein the turret has portions defining a downwardly opening circular hole, and wherein the pivot axle extends upwardly through said hole, and a snap ring engages with a groove in the pivot axle to retain the turret on the body.

* * * * *